US005118036A

United States Patent [19]

Mandersson

[11] Patent Number: 5,118,036

[45] Date of Patent: Jun. 2, 1992

[54] PACKAGING CONTAINER AND MATERIAL FOR MANUFACTURE OF THE SAME

[75] Inventor: Ragnar Mandersson, Lausanne, Switzerland

[73] Assignee: Tetra Pak Holdings SA, Pully, Switzerland

[21] Appl. No.: 721,408

[22] Filed: Jun. 26, 1991

[30] Foreign Application Priority Data

Jul. 13, 1990 [SE] Sweden ..... 9002434

[51] Int. Cl.[5] ..... B65D 5/70

[52] U.S. Cl. ..... 229/241; 229/137; 229/216; 229/240

[58] Field of Search ..... 206/620, 621.3, 622, 206/629; 229/125.42, 137, 216, 240-242

[56] References Cited

U.S. PATENT DOCUMENTS

| | | | |
|---|---|---|---|
| 2,097,647 | 11/1937 | Scott . | |
| 2,323,505 | 7/1943 | Wilcox | 229/125.42 |
| 3,057,531 | 10/1962 | Preen . | |
| 3,107,038 | 10/1963 | Kuchenbecker | 206/621.3 |
| 3,269,644 | 8/1966 | Bump . | |
| 3,421.680 | 1/1969 | Cohee . | |
| 3,447,732 | 6/1969 | Deckys | 206/622 |
| 3,795,359 | 3/1974 | Rausing | 206/629 |
| 3,998,380 | 12/1976 | Kanelous . | |
| 4,248,351 | 2/1981 | Berg | 206/620 |
| 4,301,927 | 11/1981 | Carlsson et al. | 206/622 |
| 4,343,402 | 8/1982 | Holmström | 206/622 |
| 4,362,245 | 12/1982 | Kuchenbecker | 206/629 |
| 4,691,858 | 9/1987 | Peer, Jr. | 229/3.1 |

FOREIGN PATENT DOCUMENTS

| | | | |
|---|---|---|---|
| 0130666 | 1/1985 | European Pat. Off. . | |
| 300093 | 4/1968 | Sweden . | |
| 433737 | 6/1984 | Sweden . | |
| 940485 | 10/1953 | United Kingdom | 206/621.3 |
| 2174979 | 11/1986 | United Kingdom . | |

*Primary Examiner*—Gary E. Elkins

*Attorney, Agent, or Firm*—Burns, Doane, Swecker & Mathis

[57] ABSTRACT

In a packaging container of parallelepiped type, with material for manufacture of the same, there is, limited by means of fold lines, a fold-out corner flap (4) which contains a pouring opening (7) and serves as a pouring lip when pouring out contents in liquid form from the packaging container. In order to ensure that air can flow into the packaging container in conjunction with the pouring out of the contents the upper end wall (1) of the packaging container is provided with weakening lines (8), which diverge from the pouring opening and weaken the material to such an extent that the area at the rear end of the pouring opening stands out in a raised position obtained on the opening of the packaging container and facilitates the inflow of air.

12 Claims, 2 Drawing Sheets

PACKAGING CONTAINER AND MATERIAL FOR MANUFACTURE OF THE SAME

FIELD OF THE INVENTION

The present invention concerns a packaging container and more particularly, a packaging container of the type which is manufactured from a pliable material provided with a fold line and an upper end wall with two front corners, between which a fold-out corner flap is situated, with an openable part extending over both the corner flap and an adjacent part of the end wall. The invention also concerns a material for the manufacture of a packaging container of this type, comprising a bearing layer and a watertight thermoplastic layer attached to the bearing layer.

BACKGROUND OF THE INVENTION

Consumer packagings for liquid contents such as milk, juice or the like occur in a number of different versions. One of the better known, generally occurring packaging container types is manufactured from a flexible, pliable packaging material which contains layers of paper and thermoplastic and is fed to a packaging machine in linear form. After shaping the line packaging material into a a tubular form, the material is cross-sealed at regular intervals, whereby mainly pillow-shaped packaging containers provided with projecting sealing tabs are formed. The pillow-shaped packaging containers are converted to a mainly parallelepiped shape by the projecting sealing tabs being folded down and the mainly triangular, double-wall corner flaps occurring in the shaping being folded inwards and sealed to the outside of the packaging container. A packaging container of this type is thereby given an upper end wall which is mainly rectangular and has a fold-out corner flap at each short end. One corner flap is, like the adjacent part of the upper end wall, provided with a weakening and tear indicator line which makes it possible to tear off a part of the corner of the packaging container and thereby obtain a suitable pouring opening whose form and extent can vary as a result of the adaptation to the type of product for which the packaging container is intended.

When the packaging container is to be opened, the corner flap provided with the opening device is freed from its seal against the side wall of the packaging container and is folded upwards and flattened from the sides, so that the consumer can tear off the part intended for this purpose and, provide a pouring opening. In order to ensure at the pouring thereby out of the contents through the pouring opening that a corresponding volume of air can simultaneously flow into the packaging container, the tear indication is usually shaped with a longish rear end, which mainly runs onward to the central part of the upper end wall. If the consumer does not open the packaging container completely, i.e. stops the tearing of the openable part before the material has broken as far as the aforesaid central part of the end wall, a surge problem arises in the pouring out of the contents, since the air is completely or partly prevented from penetrating into the packaging container. The same problem can also arise with certain product types of more viscous consistency.

In order to eliminate the above problem it has been proposed that the packaging container should be provided at the rear end of the upper end wall with a separate air hole, which is opened in connection with the opening of the packaging's pouring opening. It is, however, difficult to provide any form of automatic opening of this air hole, which makes two separate opening maneuver necessary before the pouring out of the contents. This has in practice proved difficult to put into effect, and the problem of poor air intake and therewith the ensuing surge problem therefore remains to a certain extent.

OBJECTS AND SUMMARY OF THE PRESENT INVENTION

There is thus a general desire to provide a packaging container of the above type in which the opening procedure automatically leads to a pouring opening of such a shape that the contents can without any problem flow out at the same time as the lost volume of contents in the packaging is replaced with air flowing in from outside.

An aim of the present invention is to provide a packaging container with a pouring opening which has such a shape and size that air can flow in unhindered into the packaging container as soon as one has begun the pouring out of the contents.

A further aim of the present invention is to provide a packaging container with a shape that ensures, upon opening, that the pouring opening formed enables outflow of the contents without any surge problem, even if the packaging container is fully filled, i.e. completely filled with contents and lacking what is called head space.

A further aim of the present invention is to provide a packaging container of the above type, which has a shape and design which largely accords with already known parallelepipedic types of packaging container and which can hence without difficulty be manufactured in the same type of packaging machine.

These and other aims have according to the invention been achieved through the fact that a packaging container of the initially mentioned type has been given the characteristic that the upper end wall has two weakening lines, diverging in relation to each other, extending from the rear end of the openable part.

An aim of the present invention is also to provide a material for the manufacture of a packaging container of the type initially mentioned, with this material being of such a design that it can be shaped without hindrance into packaging containers in conventional packaging machines without these needing to be modified or altered in any decisive manner.

A further aim of the present invention is to provide a material for the manufacture of the above packaging container, with this material resulting, through only a simple modification in relation to the known materials for parallepipedic packaging containers, in a packaging container with considerably improved pouring properties.

The above and other aims have been achieved according to the invention through the fact that a material of the type mentioned in the introduction is designed such that the surface of the material corresponding to the upper end wall comprises a number of lines weakening the material, which are arranged at an angle to each other so as together to delimit an area which, when the material is shaped into a packaging container, is arranged so as to stand out in a raised position obtained on the opening of the container.

Through providing the material in the upper end wall of the packaging container with two suitably placed fold lines an automatic folding of the upper end wall is obtained in conjunction with the corner flap being raised and flattened from the side, which happens in the normal opening maneuver. The folding along the aforementioned weakening lines results in the area of the end wall that is situated at the rear end of the pouring opening being raised to a higher level than the original level of the end wall and standing out in this position, which, when the packaging container is tipped up to pour out the contents through the pouring opening, results in the rear end of the pouring opening getting into a somewhat higher position than with conventional packaging containers, so that the inflow of air to replace the volume of contents poured out is considerably facilitated.

BRIEF DESCRIPTION OF THE DRAWING FIGURES

A preferred embodiment of the packaging container and the material for manufacture of the same according to the invention will now be described with particular reference to the enclosed schematic drawings, which only show those details indispensable for the understanding of the invention.

DETAILED DESCRIPTION OF THE PREFERRED EMBODIMENT

Figure 1:
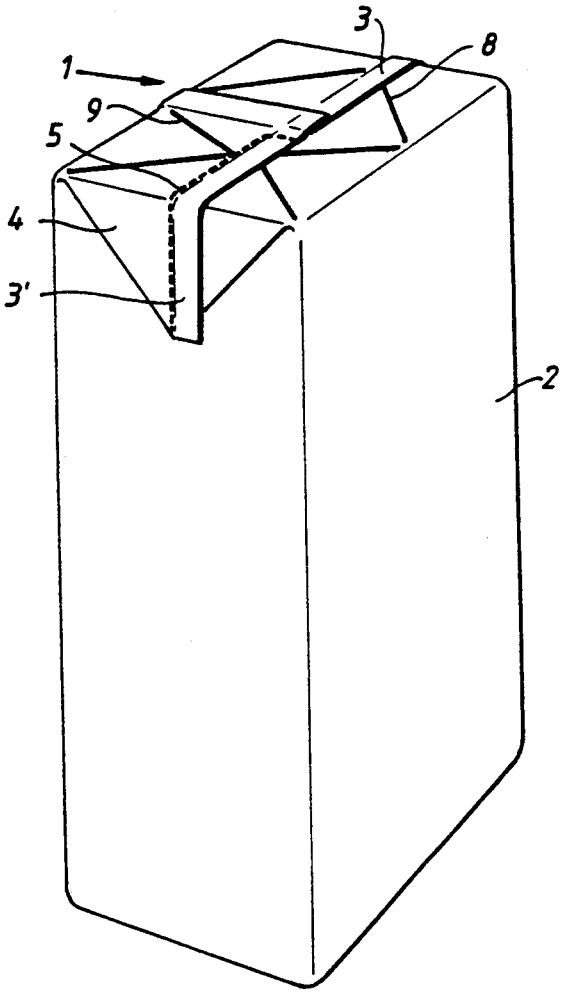
FIG. 1 is a perspective view of a packaging container according to the invention in the unopened state.

Generally speaking, the packaging container according to the invention shown in FIG. 1 is of the well known type which is manufactured from a flexible packaging laminate containing a central bearing layer of fibrous material, for example paper, which is lined on both sides with watertight layers of thermoplastic material, for example polythene. The packaging laminate includes a pattern of fold lines, which facilitates the shaping of the originally linearformed packaging laminate to the finished, mainly parallepipedic packaging container.

The shaping of the linear packaging laminate into individual, parallelepipedic packaging containers is done through the linear laminate being successively shaped into a tubular form so that both its longitudinal edges overlap each other and can be given a watertight seal with the aid of heat and the thermoplastic layer present on the outside of the laminate. As soon as a watertight longitudinal joint has been formed the tube is filled with contents of the desired type, e.g. milk, juice or the like, after which the tube is cross-sealed at regular intervals so that a connected strip of mainly pillow-shaped, filled packaging containers results. With the aid of transverse cuts in the sealing surfaces the individual packaging containers are separated and subjected to a final shape processing. In the processing to the desired parallelepiped shape four triangular double-wall corner flaps result, which are pressed flat and folded to lie against the respective parts of the outside of the packaging container and are maintained in this position through heat sealing. At the same time the sealing tabs occurring in the cross sealing of the upper and lower ends of the packaging container are folded to lie against the outside of the packaging container and through this a mainly parallelepipedic shape occurs, which is maintained until the packaging container is opened.

Figure 2:
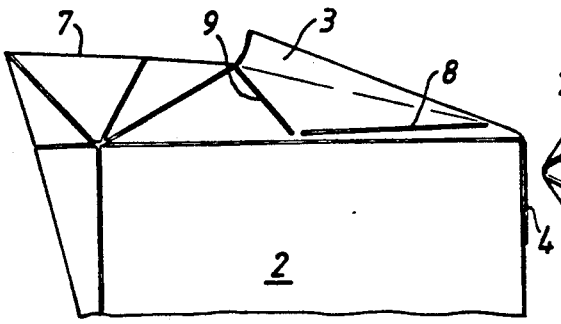
FIG. 2 is a side view of the upper part of the packaging container shown in FIG. 1 in the opened state.
Figure 3:
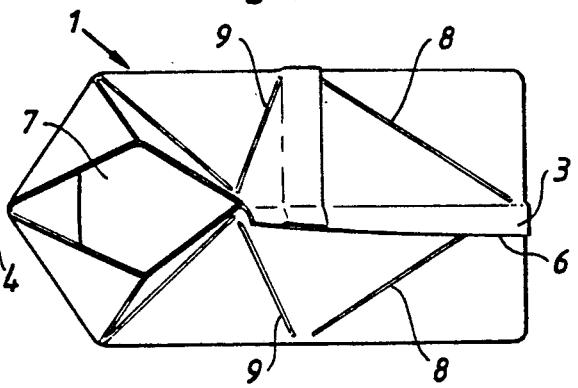
FIG. 3 is a top view of the packaging container shown in FIG. 2.

As can be seen in particular from FIGS. 1, 2 and 3 the packaging container according to the invention formed in the above manner is given a parallelepiped shape with an upper end wall 1, four side walls 2 and a lower end wall, not shown. In the embodiment shown the upper end wall 1 is mainly rectangular, and a sealing tab 3 which is laid flat and lies against the end wall extends mainly in the centre over the end wall between the two short sides of the end wall. On the aforementioned short sides two corner flaps 4 are situated linking with the two front and rear corners of the upper end wall 1, and the sealing tab 3 runs along over the corner flaps to terminate at the free corners of the respective corner flaps 4 facing away from the end wall. At one or the front end of the upper end wall 1 the sealing tab 3 is provided with an opening indication 5 in the form of a line weakening the packaging material, e.g. a perforation, which extends along the underside of the sealing tab between the end of the tab and an area near the central part of the upper end wall 1, where the perforation runs up against the free edge 6 of the sealing tab. The opening indication thus delimits an openable part 3' of the sealing tab 3, with this part extending both over the corner flap 4 and the adjacent part of the end wall 1. When the packaging container is to be opened to enable the pouring out of the contents the corner flap 4 provided with the opening indication is first freed from the outside of the packaging container, after which it is folded upwards and pressed together from the sides at the same time as the tear-off part 3' of the sealing tab 3 is torn along the opening indication 5. By this means a pouring opening 7 is formed, and the pouring out of the contents is facilitated by the fact that the present corner flap 4 in its folded-up state forms a pouring lip.

When the packaging container is tipped forward after opening for the purpose of pouring out a part of the contents through the pouring opening 7 it is desirable that the contents should leave the pouring opening in the form of an even, collected stream of liquid. In order to ensure this it is required that the volume of contents in the packaging container flowing out at the pouring out of the contents should be replaced by in flowing air, which is effected through the fact that air can flow in via the rear end of the pouring opening, i.e. the part facing the corner flap 4 of the upper end wall 1 which is not folded upwards. In order to ensure this it is important that the consumer on opening the packaging container really uses the whole length of the opening indication 5, i.e. tears off the tear-off part so that the pouring opening 7 is given its maximum length. If this is not the case or if the contents present in the packaging have a high viscosity it can happen that a sufficient quantity of air does not flow into the packaging container during the first part of the opening process, particularly if the packaging container is completely filled. According to the invention, however, this disadvantage can be eliminated if one sees to it that the rear end of the pouring opening 7 is given a raised position in relation to other parts of the upper end wall of the packaging container, which gives a greater margin and ensures that the necessary amount of air flows into the packaging even in difficult pouring conditions. In order to achieve the desired raising of the rear end of the pouring opening 7 the upper end wall of the packaging container according to the invention is provided with two weakening lines 9, which extend from the rear end of the openable part and diverge in relation to each other. The lines 9 diverge more specifically in a direction towards the rear part of the upper end wall 1, which is preferably provided with two other weakening lines 8, which together with the two first weakening lines 9 enclose a central, mainly rhomboid area of the end wall. Through providing the end wall 1 with both the front and rear weakening lines 8, 9 the end wall acquires a tendency to fold at these lines in conjunction with the folding up and pressing together of the front corner tab 4 when the packaging container is to be opened. The rhomboid area situated between the fold lines 8,9 by this means forms a sloping plane, which connects at its rear end with the original level of the upper end wall 1 and at its front end is 3 to 6 mm above the said level, which makes it possible for the rear end of the pouring opening 7 to be raised a corresponding distance in relation to the surface of the liquid at the pouring out of the contents from the packaging. This gain in level ensures that air can flow into the packaging container even when the consumer has not opened it completely or the current product, owing to its viscosity, has an increased tendency to surge.

With the aid of especially the two front weakening lines 9 the upper end wall 1 of the packaging container is given a concentrated weakening, which sees to it that the part of the end wall stands out in the upper position it naturally assumes in conjunction with the folding upwards of the corner flap 4 and the opening process. This tendency is reinforced and made permanent when the lines 9 extend symmetrically on both sides of the sealing tab 3, and it has proved to be optimum if the first weakening lines 9 extend mainly in the direction of the middle of the upper end wall 1 with side edges parallel to the sealing tab 3. According to a preferred embodiment the angle between the first weakening lines 9 is approximately 120°, but the weakening lines 9 have proved to give a certain effect even with a different line, and an improvement has been observed when the fold lines have a mutual angle of between 60° and 160°.

The two rear weakening lines 8 are likewise arranged mainly symmetrically in relation to the sealing tab 3, and the angle between them is preferably in the main 60°. In order to achieve the desired effect it has proved suitable if the angle between the rear weakening lines is at the maximum 90°.

The weakening lines 8, 9 can be made as conventional fold lines, where the packaging material is pressed together in linear form in order to obtain the desired weakening, but it is also possible to form the weakening lines in another manner, e.g. through linear perforation of the bearing layer. If the weakening lines 9 can in this way be made sufficiently strong, the two rear weakening lines can if desired be omitted since the front lines 9 weaken the material to a sufficient degree to ensure a maintained raised position of the end wall 1 at the rear end of the pouring opening 7.

Figure 4:
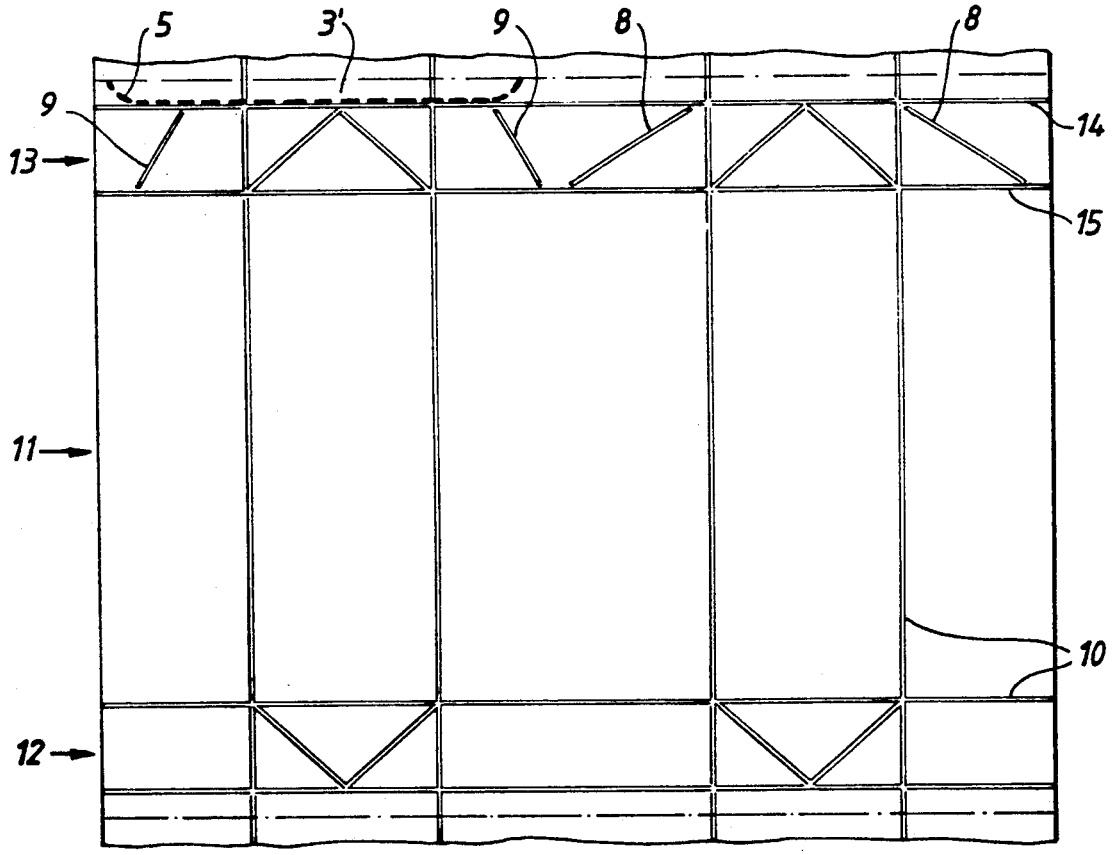
FIG. 4 is a top view of a material for a packaging container according to the invention in a laid flat state.

A material for manufacture of a packaging container according to the invention is shown in FIG. 4. The material consists of a terminated material containing e.g. a bearing layer of paper, which is lined on both sides with homogeneous layers of thermoplastic material, e.g. polythene. The material shown can form part of a packaging material line and contains a pattern of fold lines 10, which divides the material into rows of a number of wall panels, e.g. side wall panels 11, bottom panels 12 and upper end wall panels 13. The pattern of fold lines also comprises fold lines for the formation of the corner flaps 4 but is mainly conventional and should therefore not need to be described in greater detail in this connection. By means of a dotted line the opening indication 5 is also indicated, which has the form of a perforation which extends in the narrow area at one side of the packaging container material which is to form the upper sealing tab 3 of the packaging container. With thick, solid lines the two front weakening lines 9 are also indicated as well as the two rear weakening lines 8 according to the invention, which are placed on the end wall panels 13 delimited by means of the fold lines 10 which will together form the upper end wall 1 in the finished packaging container. The weakening lines 9 extend mainly at an angle between on the one hand a fold line 14, which delimits the field which forms the sealing tab 3 in the finished packaging, and a fold line 15 parallel to fold line 14, which in the finished packaging delimits the upper end wall 1 from the adjacent side walls 2. The angle of the weakening lines 8, 9 to the two fold lines 14, 15 varies depending on the size and shape of the current packaging container, but remains within those limits which are determined by the previously mentioned angle values.

While this invention has been illustrated and described in accordance with a preferred embodiment, it is recognized that variations and changes may be made and equivalents employed herein without departing from the invention as set forth in the claims.

What is claimed is:

1. A packaging container manufactured from pliable material, and comprising: an upper end wall, an oppositely positioned bottom end wall and a plurality of side walls extending between the upper end wall and the bottom end wall, said upper end wall having two front corners between which a fold-out corner flap is positioned, an openable part extending over the corner flap and a part of the upper end wall positioned adjacent said corner flap, said openable part having a rear end positioned away from said corner flap, a first pair of weakening lines extending from a point adjacent the rear end of the openable part and diverging away from one another, and a second pair of weakening lines positioned at a rear part of the upper end wall, said first and second pairs of weakening lines enclosing a substantially rhomboid-shaped area of the upper end wall.

2. The packaging container according to claim 1, wherein said first pair of weakening lines diverge from one another in the direction of the rear part of the upper end wall.

3. The packaging container according to claim 1, including a sealing tab situated substantially centrally on the upper end wall with a front end of the sealing tab containing said openable part, the two weakening lines of said first pair of weakening lines being positioned substantially symmetrically on opposite sides of said sealing tab and the two weakening lines of said second pair of weakening lines being positioned substantially symmetrically on opposite sides of said sealing tab.

4. The packaging container according to claim 3, wherein said upper end wall includes oppositely positioned sides that extend substantially parallel to said sealing tab, the two weakening lines of said first pair of weakening lines extending substantially towards a middle of the sides of the upper end wall.

5. The packaging container according to claim 1, wherein the two weakening lines of said first pair of weakening lines form an angle between one another of between about 60° and about 160°.

6. The packaging container according to claim 1, wherein the two weakening lines of said first pair of weakening lines form an angle between one another of approximately 120°.

7. The packaging container according to claim 1, wherein the two weakening lines of said second pair of weakening lines form an angle between one another of less than about 90°.

8. The packaging container according to claim 1, wherein the two weakening lines of said second pair of weakening lines form an angle between one another of about 60°.

9. A blank from which a packaging container having an upper end wall, an oppositely positioned bottom end wall and side walls for receiving contents is formed, comprising: a bearing layer and a watertight thermoplastic layer laminated to one another, said blank including a plurality of fold lines, said fold lines dividing said blank into a plurality of side wall panels, a plurality of bottom end wall panels and a plurality of upper end wall panels that define that side walls, the bottom end wall and the upper end wall respectively of the packaging container when the blank is folded and formed into the packaging container, two of said upper end wall panels each including two fold lines which define oppositely located corner flaps that are positioned between front corners and rear corners respectively of the upper end wall of the packaging container after folding and formation of the packaging container, said upper end wall panels also including a first pair of weakening lines and a second pair of weakening lines, said first and second pairs of weakening lines being arranged such that when the blank is folded and formed into a packaging container the first and second pairs of weakening lines define a central area on the upper end wall of the packaging container that stands out in a raised position upon upward folding of one of the corner flaps and opening of the packaging container.

10. The blank according to claim 9, wherein the plurality of folding lines includes fold lines that divide a portion of the blank adjacent the upper end wall panels into panels that define a sealing tab which lies against the upper end wall of the packaging container when the blank is folded and formed into the packaging container, and including a perforation which extends across some of the panels that define the sealing tab, said perforations defining an openable part for opening the packaging container after the blank is folded and formed into a packaging container.

11. The blank according to claim 10, wherein said first pair of weakening lines are positioned such that upon folding and forming of the blank into the packaging container the first pair of weakening lines extend away from a point adjacent a rear end of the openable part and diverge away from one another.

12. The blank according to claim 9, wherein said first and second pairs of weakening lines are located in upper end wall panels different from the upper end wall panels in which the fold lines defining the corner flaps are located.

* * * * *